US005913238A

United States Patent [19]

Lanham et al.

[11] Patent Number: 5,913,238

[45] Date of Patent: Jun. 15, 1999

[54] METHOD OF CONTROLLING BULGING OF GABLE TOP CARTONS

[75] Inventors: Robert L. Lanham, Mobile; Joe L. Kinsey, Jr., Irvington, both of Ala.; Charles E. Gibbons, Cincy, Ohio

[73] Assignee: International Paper Company, Tuxedo Park, N.Y.

[21] Appl. No.: 08/857,561

[22] Filed: May 16, 1997

[51] Int. Cl.[6] ..... G01M 3/34; B65D 5/72

[52] U.S. Cl. ..... 73/49.3; 229/249

[58] Field of Search ..... 73/49.3; 229/249

[56] References Cited

U.S. PATENT DOCUMENTS

| | | | |
|---|---|---|---|
| 2,362,862 | 11/1944 | Sidebotham | 229/249 |
| 4,124,159 | 11/1978 | Schwarzkopf | 229/249 X |
| 4,712,727 | 12/1987 | Wyberg | 229/249 |
| 4,756,426 | 7/1988 | Wyberg | 229/249 |
| 4,792,048 | 12/1988 | Wyberg | 229/249 |
| 4,813,547 | 3/1989 | Wyberg | 229/249 X |
| 4,869,372 | 9/1989 | Wyberg | 229/249 |
| 4,869,373 | 9/1989 | Wyberg | 229/249 |
| 4,989,736 | 2/1991 | Andersson et al. | 229/249 X |

*Primary Examiner*—Richard Chilcot
*Assistant Examiner*—Paul D. Amrozowicz
*Attorney, Agent, or Firm*—Hoffman, Wasson & Gitler; Michael J. Doyle, Esq.

[57] ABSTRACT

A method of decreasing the bulge of gable top cartons by evaluating and modifying top sealing heat patterns. Cartons are formed, dye stained and the quality of the seal evaluated for heat damage and top seal quality. The heating pattern is adjusted as required, and the resulting heat seal is reevaluated to determine if further adjustments are required, so that the resulting cartons can achieve a near air-tight condition in the headspace of the carton to thereby resist bulging.

12 Claims, 3 Drawing Sheets

GABLE-TO-GABLE BULGE IS MEASURED AS SHOWN. TO MEASURE SIDE-TO-SIDE BULGE, THE CARTON IS ROTATED 90 DEGREES FROM THE POSITION SHOWN BELOW.

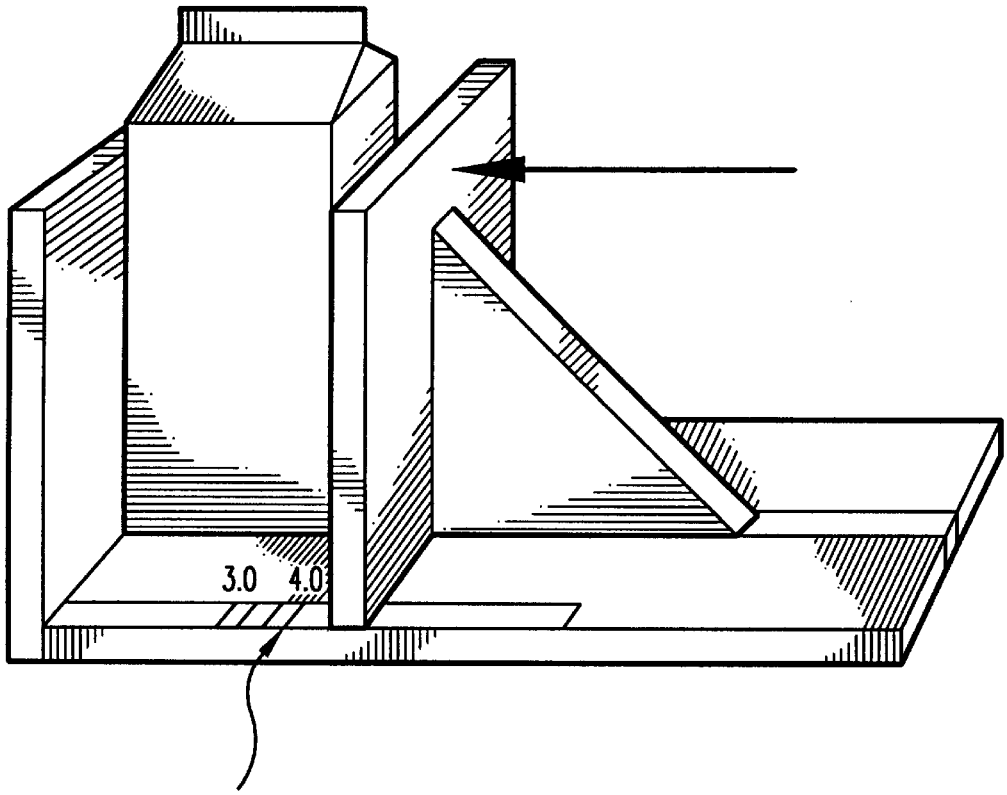

SCALE IS MOUNTED SO THAT 1/32nds INCH OVER 4.0 IS RECORDED AS BULGE FOR HALF GALLONS (OVER 3.0 INCH FOR QUARTS). THE SCALE MOUNTED WITH THE FIRST 1/8 INCH OF THE SCALE REMOVED SO THAT THE ZERO BULGE POINT OCCURS AT 4.0 AND 3.0 INCHES FOR HALF GALLONS AND QUARTS, RESPECTIVELY, FOR SIMPLICITY.

BULGTEST.PRE

FIG.3

METHOD OF CONTROLLING BULGING OF GABLE TOP CARTONS

BACKGROUND OF THE INVENTION

1. Field of the Invention

The present invention relates to a method of decreasing the bulging of gable top cartons filled with liquid products. More particularly, the present invention relates to a method of increasing the air-tightness of the carton top seal by achieving a good seal, and eliminating heat activation pinhole damage below the top seal, which was acceptable in conventional containers, but which defeats the benefits of a good seal, with regard to air-tightness. The present invention creates the necessary conditions for formation of a partial vacuum in the headspace air, as the carton side walls start to bulge. The partial vacuum offsets the hydrostatic forces within the liquid, thereby decreasing the rate at which the carton bulges over a period of time.

2. Description of the Prior Art

Gable top cartons are widely used to contain liquids and are made from paperboard coated on their inner and outer surfaces with a thermoplastic coating such as low density polyethylene (LDPE). The coated paperboard is scored to define individual panels, and is folded along the score lines. The edges are sealed to form the carton.

Gable top cartons have a tendency to gradually change cross-sectional shape from square or rectangular cross-section to a rounded cross-section, otherwise known as bulging. Such bulging of gable top cartons is a common problem, especially when the shelf life of the carton exceeds fourteen days. Products packaged in gable top cartons can have shelf lives ranging up to 120 days.

The tendency of gable top cartons to bulge was previously believed to be caused by the physical properties of the paperboard and to some extent the quality of the top seals. It was believed that high top seal heat directed over an area covering and extending slightly beyond the area to be sealed provided a good top seal. Consequently, most efforts to improve bulge resistance of gable top cartons have been focused on improving the physical properties of the paperboard. For instance, foil laminated gable top cartons have been used for some time, and show greater resistance to bulging than non-foil cartons. The improved resistance to bulging was attributed to the improved physical properties resulting from foil lamination in the packaging. However, the concept of controlling bulge resistance of gable top cartons exclusively by improvements to the physical properties of the paperboard severely limits the success of controlling bulging.

While improvements to the physical properties of paperboard can improve bulge resistance, such improvements involve adding material or layers to the paperboard which increases costs in both labor, machinery and material.

SUMMARY OF THE INVENTION

These and other deficiencies of the prior art are addressed by the present invention which is directed to a method for improving the air tightness of the carton top seal.

The inventors of the present invention have found that the overall quality of the top seal of a gable top carton is a major contributing factor in the ability of a gable top carton to resist bulging. More importantly, the inventors have discovered that top seal quality relies on two factors, with regard to the effect on carton bulge: (1) the integrity of the seal and (2) the amount of heat activation pinhole damage in the area contiguous to the top seal.

Consequently, the present invention provides a method for evaluating the quality of the top seal of representative cartons, from a production run, to monitor and control the bulge resistance of the gable top cartons produced.

BRIEF DESCRIPTION OF THE DRAWINGS

These and other attributes of the present invention will be described with respect to the following drawings in which:

FIG. 3 is a perspective view of a device used to measure bulge of a gable top carton.

DETAILED DESCRIPTION OF THE INVENTION

It has been found that the significance of top seal quality on the bulge resistance of gable top cartons plays a significant role in the ability of a gable top carton to resist bulging. Improvements in the top seal quality, i.e. the elimination of heat activated pinholes in the polymer coating and top channel leaks, provides excellent control over bulging of the carton. Careful control of top seal quality can reduce the bulging of non-foil cartons by as much as 75% over a shelf life of 60 to 120 days. As a result, by such control, non-foil cartons having equal bulge resistance to aluminum foil laminating cartons can be produced.

From these findings, the inventors have determined that excellent bulge resistance of foil cartons is not due as much to improvements in the physical properties of the structure imparted by the foil, as it is due to the inherent excellent top seal quality obtained with foil laminated cartons, particularly the protection against heat activated pinholes provided by foil. As a result, the present method for measuring top seal quality as it relates to bulging has been developed.

Figure 1:
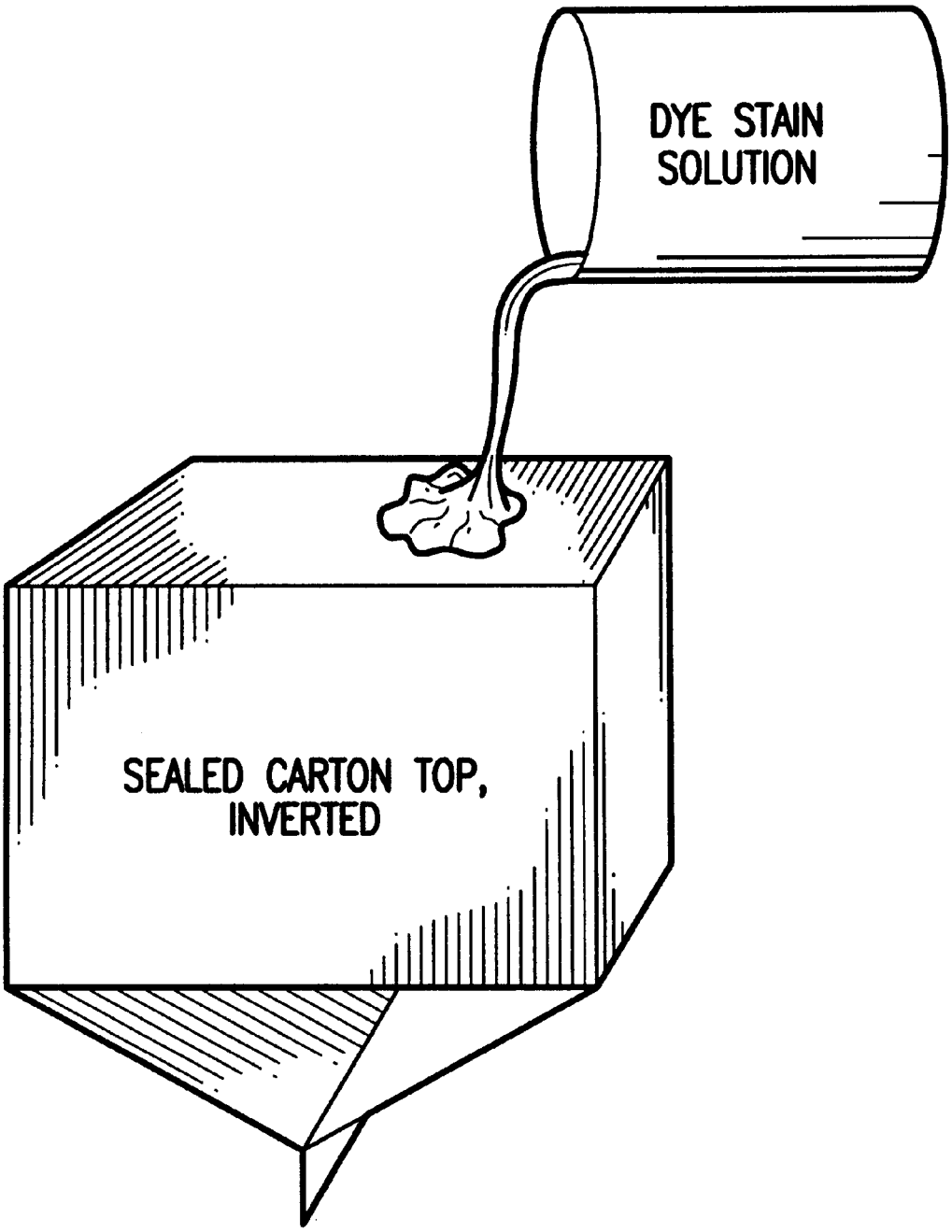
FIG. 1 is a perspective view of dye staining of a carton top seal, which is the preferred method for checking for top seal integrity and heat activation pinhole damage.
Figure 2:
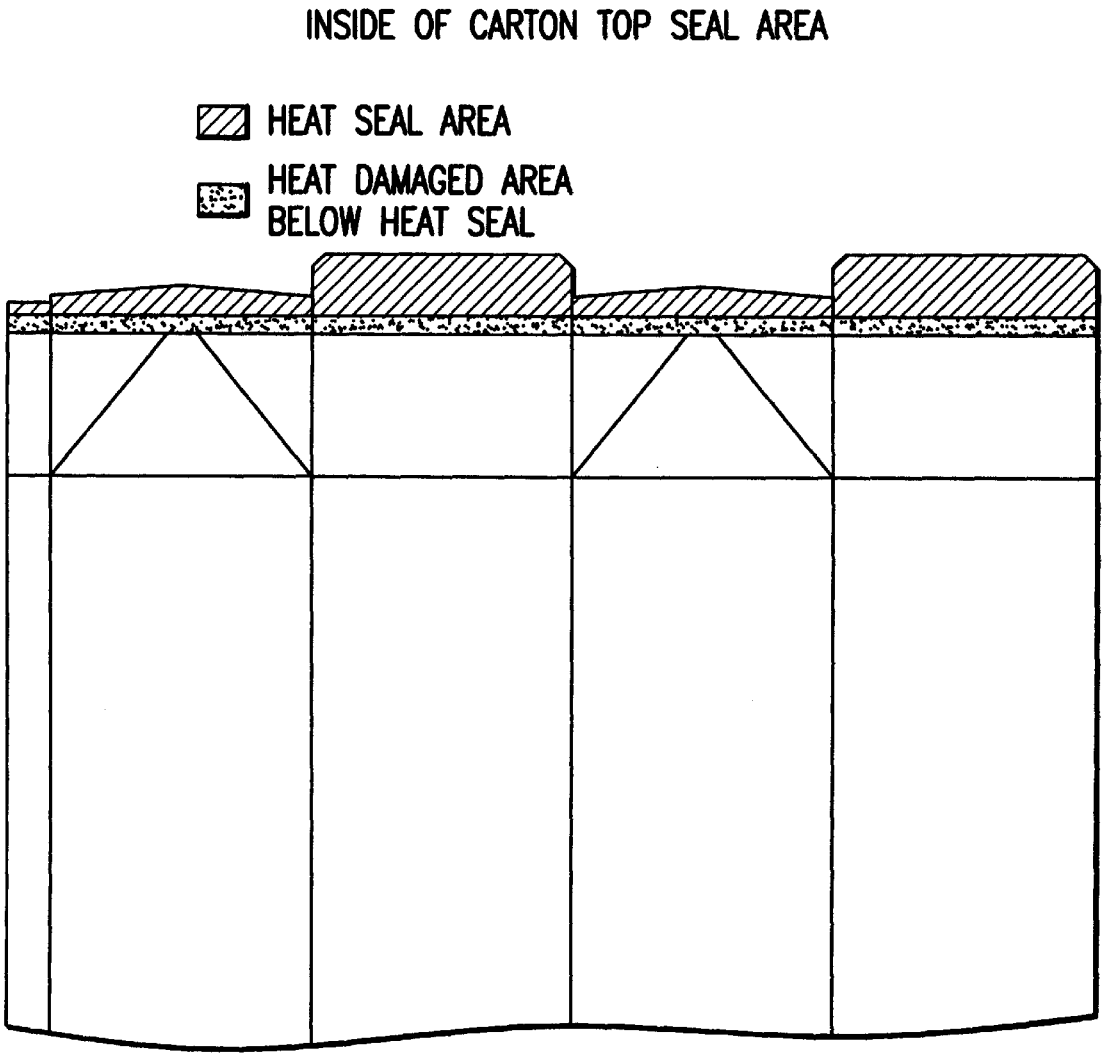
FIG. 2 is a partial planar view of carton blank showing top seal damage which must be eliminated to effect a true near-airtight top seal.

Referring to FIG. 1, the method of the present invention involves taking a filled and sealed gable top carton, cutting the unopened top from the carton (approximately the top four inches), inverting the top, then pouring stain solution into the interior of the sealed top. After two minutes, the dye stain solution is poured from the carton top and the interior of the top is rinsed with water. The top is then opened, pulled apart at the side seam and laid flat for inspection as shown in FIG. 2. Heat damage (shown in black) below the top seal area (shaded) allows air to enter easily into the headspace of the carton, preventing the creation of a partial vacuum in the headspace when the product level in the carton drops due to bulging of the carton side panels. Without the development of a partial vacuum, the full force of the liquid fill product hydrostatic pressure acts upon the interior surfaces of the carton side panels resulting in greater bulge than for a carton with no heat activation pin hole damage below the top seal area. The method and apparatus for measuring bulge is shown in FIG. 3.

Proper redesign and positioning of the top heater head on the carton filling machine will eliminate the heat damage without adversely affecting the quality of the seal itself.

Once the seal has been quantified and any seal defects identified, several techniques can be employed to improve the top seal condition, if improvement is required. First the filling machine can be adjusted. This is the most important and the most difficult aspect for the carton manufacturer to control. The top heater heads or nozzles have to be properly adjusted so that no heat activated defects occur outside the areas of the carton that actually form the top seal. Therefore, both the position of the heater head or nozzle relative to the carton top and the heat pattern produced by the heater head or nozzle must be adjusted.

Another technique for minimizing top seal defects is to design packaging materials that are resistant to defect formation during heat sealing operations. Yet another technique is to design packaging structures and packaging equipment that utilizes alternative sealing methods not prone to the heat activated defects of traditional heat sealing. Further, another technique is to alter the package configuration to minimize or eliminate the defects normally caused during heat sealing.

After any adjustments are made, the seal quality quantification method described with reference to FIGS. 1 and 2 can be performed again to evaluate the top seal and make further adjustments as required.

Having described the method of the present invention, it is believed that other modifications, variations and changes will be suggested to those skilled in the art in view of the description set forth above. It is therefor to be understood that all such variations, modifications and changes are believed to fall within the scope of the invention as defined in the appended claims.

What is claimed is:

1. A method of decreasing bulge of gable top cartons comprising the steps of:

filling and sealing a paperboard carton;

removing the top portion of the paperboard carton;

staining said top portion by pouring stain into said top portion;

pulling apart said top portion;

evaluating a top seal of said deconstructed top portion for quality and heat damage;

adjusting carton forming equipment used to form said top seal to correct heat patterns produced by said carton forming equipment and reduce said heat seal damage; and forming a new paperboard carton using said adjusted carton forming equipment.

2. A method as recited in claim 1, comprising the further step of creating a partial vacuum in said new paperboard carton.

3. A method as recited in claim 1, wherein said carton forming equipment comprises a top seal heater head.

4. A method as recited in claim 1, wherein said evaluating step includes determining if any pinhole damage is present.

5. A method as recited in claim 1, wherein said evaluating step includes determining the extent and quality of said top seal.

6. A method as recited in claim 2, further comprising the steps of:

re-performing said steps of filling and sealing, cutting off said upper portion, staining, pulling apart said stained upper portion, and evaluating on said new paperboard carton, to determine if said top seal of said new paperboard carton will be able to maintain said partial vacuum.

7. A method as recited in claim 6, further comprising the steps of:

readjusting said carton forming equipment used to form said top seal to reduce said heat seal damage; and forming a second new paperboard carton using said adjusted carton forming equipment.

8. A method as recited in claim 6, further comprising the steps of:

readjusting said carton forming equipment used to form said top seal to reduce said heat seal damage;

forming an additional paperboard carton using said adjusted carton forming equipment; and repeating said method until a top seal is formed which is capable of maintaining said partial vacuum.

9. A method as recited in claim 2, further comprising the step of repeating said method until a top seal is formed which is capable of maintaining said partial vacuum.

10. A method of decreasing bulge of gable top cartons comprising the steps of:

filling and sealing a paperboard carton;

deconstructing said paperboard carton;

quantifying quality of a top seal and heat damage of said paperboard carton;

adjusting carton forming equipment used to form said top seal to correct heat patterns produced by said carton forming equipment and reduce said heat seal damage; and forming a new paperboard carton using said adjusted carton forming equipment.

11. A method as recited in claim 10, comprising the further step of creating a partial vacuum in said new paperboard carton.

12. A method as recited in claim 11, further comprising the step of repeating said method until a top seal is formed which is capable of maintaining said partial vacuum.

* * * * *